US007284534B2

(12) United States Patent
Fukumori

(10) Patent No.: US 7,284,534 B2
(45) Date of Patent: Oct. 23, 2007

(54) INTAKE APPARATUS AND MANUFACTURING METHOD FOR THE SAME

(75) Inventor: Sadahito Fukumori, Okazaki (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/600,162

(22) Filed: Nov. 16, 2006

(65) Prior Publication Data

US 2007/0113823 A1 May 24, 2007

(30) Foreign Application Priority Data

Nov. 18, 2005 (JP) ..... 2005-334250

(51) Int. Cl.
*F02D 9/10* (2006.01)

(52) U.S. Cl. ..... 123/336; 29/888.46

(58) Field of Classification Search ..... 123/336, 123/337; 29/888.84

See application file for complete search history.

(56) References Cited

U.S. PATENT DOCUMENTS 6,837,261 B2 * 1/2005 Rentschler et al. ..... 123/336
6,895,926 B1 * 5/2005 Moreau et al. ..... 123/337
6,979,130 B1 12/2005 Stangler et al.
7,089,663 B2 * 8/2006 Arai et al. ..... 29/888.4
7,107,683 B2 * 9/2006 Arai et al. ..... 29/888.4
7,219,652 B2 * 5/2007 Ino et al. ..... 123/337
2003/0009881 A1 * 1/2003 Schraudolf et al. ..... 29/888.46
2007/0051339 A1 * 3/2007 Torii et al. ..... 123/337

* cited by examiner

*Primary Examiner*—Erick Solis
(74) *Attorney, Agent, or Firm*—Nixon & Vanderhye P.C.

(57) ABSTRACT

An intake apparatus includes housings each defining an intake passage therein. The intake apparatus further includes valve members each being provided to each housing for communicating and blocking the intake passage. A shaft extends through the housings. The shaft is rotatable integrally with the valve members. A bearing member extends together with the shaft through the housings. The shaft is rotatable in the bearing member. The bearing member includes exposed portions each being exposed to the intake passage. Each exposed portion has an opening that extends with respect to an axial direction of the bearing member. The opening corresponds to a rotatable range, in which the valve member is rotatable with respect to a circumferential direction of the bearing member.

10 Claims, 6 Drawing Sheets

INTAKE APPARATUS AND MANUFACTURING METHOD FOR THE SAME

CROSS REFERENCE TO RELATED APPLICATIONS

This application is based on and incorporates herein by reference Japanese Patent Application No. 2005-334250 filed on Nov. 18, 2005.

FIELD OF THE INVENTION

The present invention relates to an intake apparatus and a manufacturing method for the same.

BACKGROUND OF THE INVENTION

For example, an intake apparatus for an internal combustion engine includes a valve that communicates and blocks an inlet passage. According to U.S. Pat. No. 6,979,130 (JP-A-2003-509634), a bearing unit accommodates a flap. The bearing unit is in a substantially C-shape, and has a resilient structure. The flap accommodated in the bearing unit radially expands the bearing unit. The flap is rotatable resiliently in the bearing unit.

In this structure, the bearing unit and the flap are individually formed, and subsequently, the flap is assembled to the bearing unit. For example, when the bearing unit is provided to a four-cylinder engine, four bearing units are assembled individually to four intake passages of the engine. Subsequently, a metallic shaft is assembled to the bearing units for rotatably supporting flaps. The shaft penetrates four of the bearing units. The manufacturing process of this intake apparatus includes forming the bearing units and flaps, assembling the flaps to the bearing units, and inserting the shaft through the bearing units. In this structure, manufacturing process is complicated.

SUMMARY OF THE INVENTION

In view of the foregoing and other problems, it is an object of the present invention to produce an intake apparatus being manufactured with reduced manufacturing process. It is another object of the present invention to produce a manufacturing method for the intake apparatus.

According to one aspect of the present invention, an intake apparatus includes a plurality of housings each defining an intake passage therein. The intake apparatus further includes a plurality of valve members each being provided to each housing for communicating and blocking the intake passage. The intake apparatus further includes a shaft that extends through the plurality of housings. The shaft is rotatable integrally with the plurality of valve members. The intake apparatus further includes a bearing member that extends together with the shaft through the plurality of housings. The bearing member is supported by the plurality of housings. The bearing member is in a substantially cylindrical shape. The shaft is rotatable in the bearing member. The bearing member includes a plurality of exposed portions each being exposed to the intake passage. Each exposed portion has an opening that extends with respect to an axial direction of the bearing member. The opening corresponds to a rotatable range, in which the valve member is rotatable with respect to a circumferential direction of the bearing member.

Alternatively, according to another aspect of the present invention, an intake apparatus includes a plurality of housings each defining an intake passage therein. The intake apparatus further includes a plurality of valve members each being provided to each housing. The intake apparatus further includes a bearing member that extends through the plurality of housings. The bearing member is fixed to the plurality of housings. The intake apparatus further includes a shaft that extends through the bearing member and the plurality of housings. The bearing member has a plurality of openings. Each valve member extends from the shaft substantially along a radial direction of the shaft. Each valve member extends into the intake passage through each opening. The shaft is rotatable in the bearing member integrally with the plurality of valve members for communicating and blocking the intake passages of the plurality of housings. Each opening extends with respect to a circumferential direction of the bearing member to define a rotatable range in which each valve member is rotatable.

Alternatively, according to another aspect of the present invention, a method for manufacturing an intake apparatus includes inserting a shaft into a bearing member. The bearing member has a plurality of openings that are axially spaced from each other for predetermined distances. The shaft has a plurality of holes that are axially spaced from each other corresponding to the plurality of openings. The method further includes insert-molding the bearing member and the shaft in resin to simultaneously form a plurality of valve members and a plurality of housings. Each valve members extends through each hole. Each housing has an intake passage that accommodates each valve member.

Alternatively, according to another aspect of the present invention, a method for manufacturing an intake apparatus includes inserting a shaft into a bearing member. The method further includes injecting resin through a plurality of openings of the bearing member and a plurality of holes of the shaft to insert-molding the bearing member and the shaft in a plurality of valve members, each extending through each hole, and a plurality of housings each accommodating each valve member.

Alternatively, according to another aspect of the present invention, a method for manufacturing an intake apparatus includes inserting a shaft into a bearing member. The method further includes aligning a plurality of openings, which are axially spaced from each other in the bearing member, with respect to a plurality of holes, which are axially spaced from each other in the shaft. The method further includes injecting resin through the plurality of openings and the plurality of holes to insert-molding the bearing member and the shaft in a plurality of valve members and a plurality of housings, such that each valve member extending through each hole and each valve member being accommodated in each housing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Example Embodiment

Figure 1:
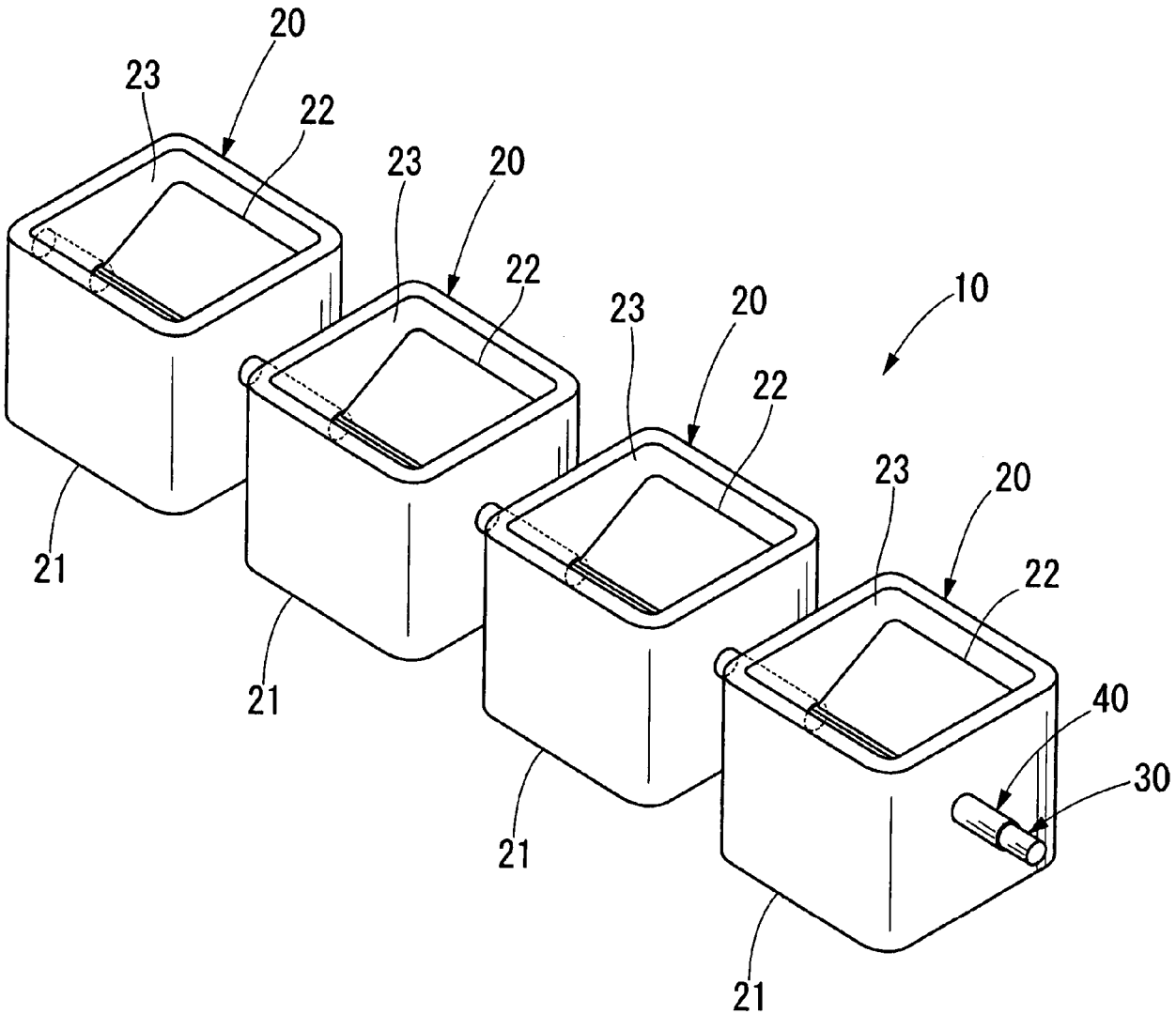
FIG. 1 is a perspective view showing an intake apparatus.

As shown in FIG. 1, an intake apparatus 10 is provided between an unillustrated surge tank and an internal combustion engine. Air flows into the intake apparatus 10 after passing through the surge tank. The intake apparatus 10 includes valve units 20, a shaft 30, and a bearing member 40. In this example, the intake apparatus 10 is provided to a four-cylinder engine, and the intake apparatus 10 includes four valve units 20.

Each of the four valve units 20 includes a housing 21 and butterfly members 22. The butterfly members 22 serve as valve members. The housing 21 is in a substantially cylindrical shape. The housing 21 defines an intake passage 23 therein. The intake passage 23 in the housing 21 defines part of an air inlet passage that connects an air cleaner with the engine through the surge tank. In this example, the intake passage 23 defined in the housing 21 has the cross section, which is in a substantially rectangular shape, with respect to the axis of the intake passage 23. The housing 21 accommodates the butterfly members 22. The butterfly members 22 are rotatable together with the shaft 30 in the housing 21. The butterfly members 22 rotate together with the shaft 30, thereby communicate and block the intake passage 23 in the housing 21. The housing 21 and the butterfly members 22 are formed of resin.

Figure 3A:
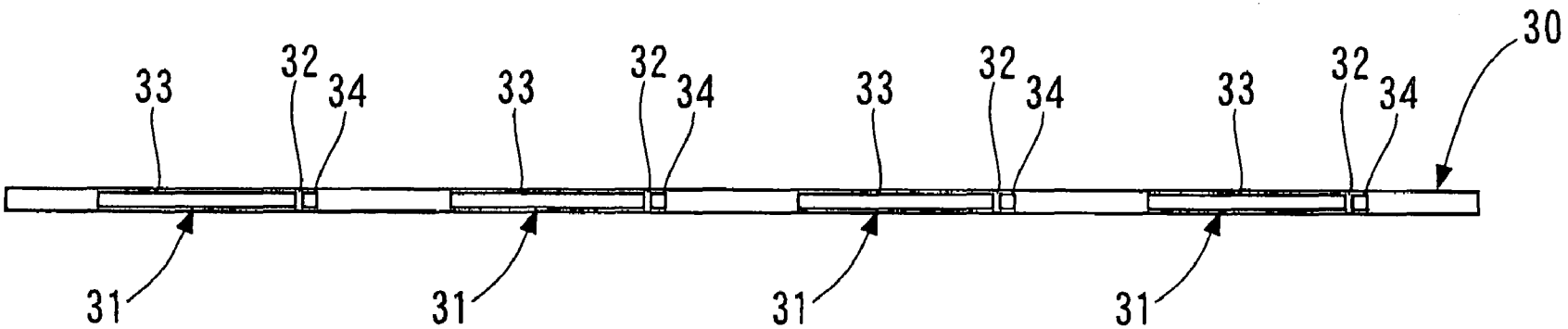
FIG. 3A is a schematic view showing a shaft of the intake apparatus.

The shaft 30 is formed of metal such as stainless steel. The shaft 30 penetrates the housing 21 of the valve units 20. As shown in FIG. 3A, the shaft 30 has holes 31, which are spaced from each other axially for substantially constant distances. Each of the holes 31 is a through hole extending radially through the shaft 30. The shaft 30 has blockade portions 32 each partially blocking the hole 31 with respect to the axial direction of the shaft 30. Each blockade portion 32 partitions the hole 31 into a large hole 33 and a small hole 34.

As shown in FIGS. 4A to 5B, each butterfly member 22 penetrates the hole 31 of the shaft 30 in the valve unit 20. That is, the butterfly member 22 extends through the hole 31 of the shaft 30. The butterfly member 22 is integrated with the shaft 30. When the shaft 30 is inserted into the housings 21 of the valve units 20, the holes 31 of the shaft 30 are exposed to the intake passages 23 defined in the housings 21. As referred to FIG. 2, the butterfly members 22 each extending through the hole 31 are supported by the shaft 30. The intake passage 23 of the housing 21 accommodates the butterfly member 22.

Figure 3B:
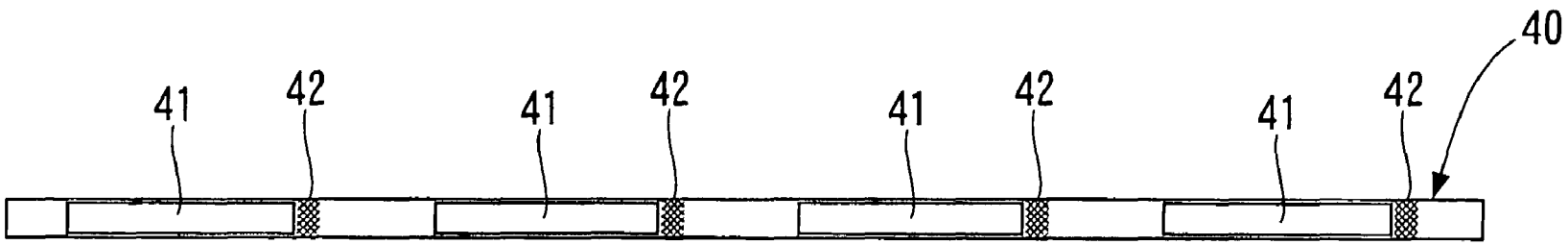
FIG. 3B is a schematic view showing a bearing member of the intake apparatus.
Figure 4A:
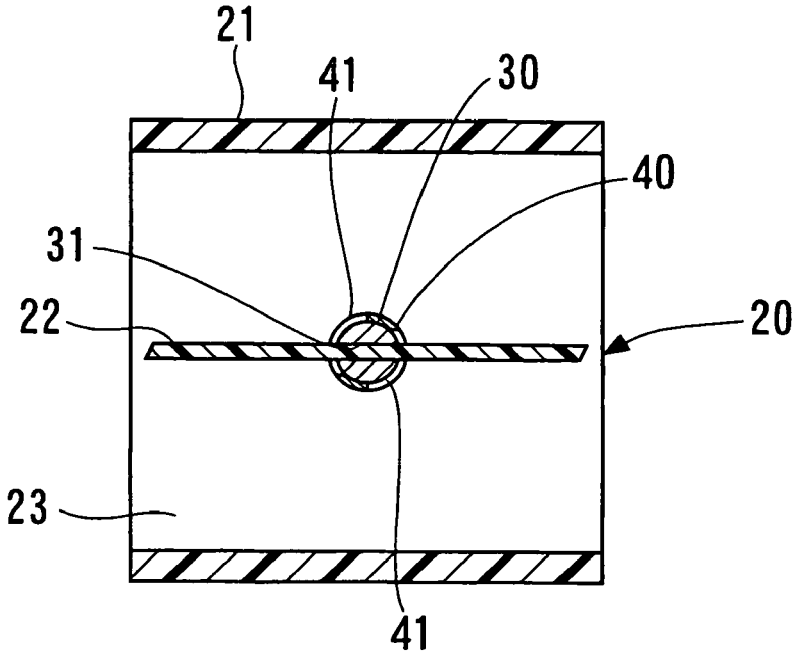
FIG. 4A is a sectional view taken along the line IVA-IVA in FIG. 2 when the intake passage opens.
Figure 4B:
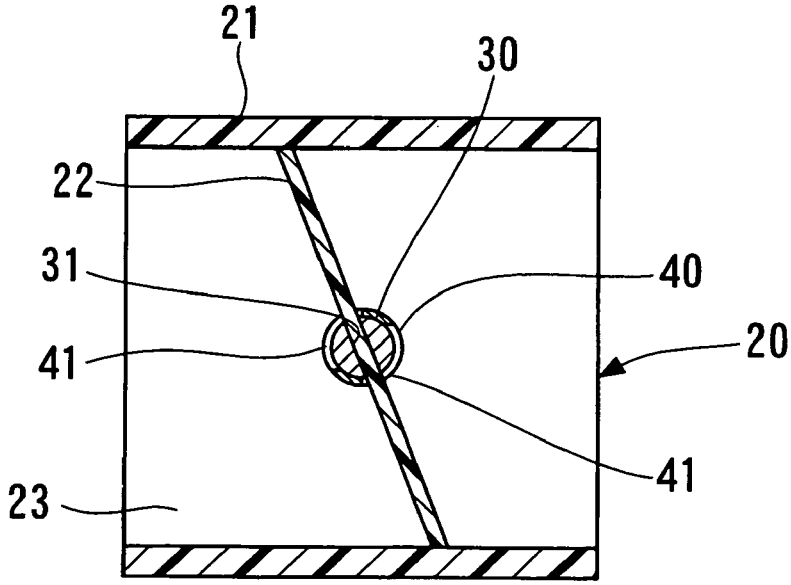
FIG. 4B is a sectional view showing the valve unit when the intake passage closes.
Figure 5A:
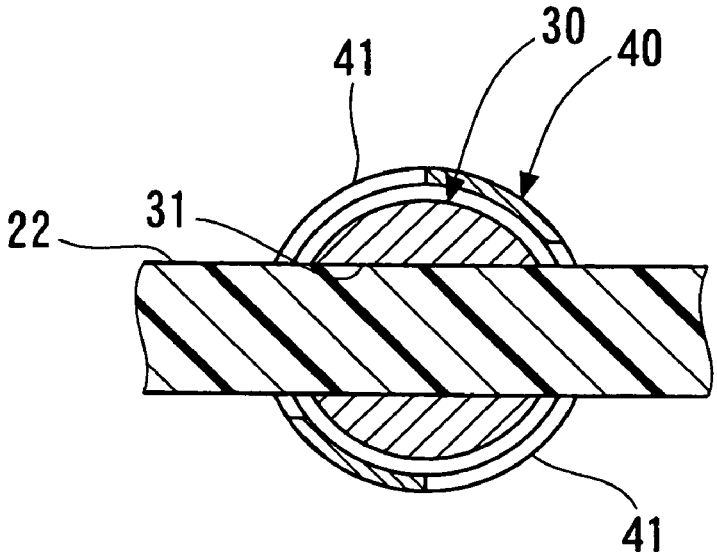
FIG. 5A is an enlarged sectional view showing the valve unit when the intake passage opens.
Figure 5B:
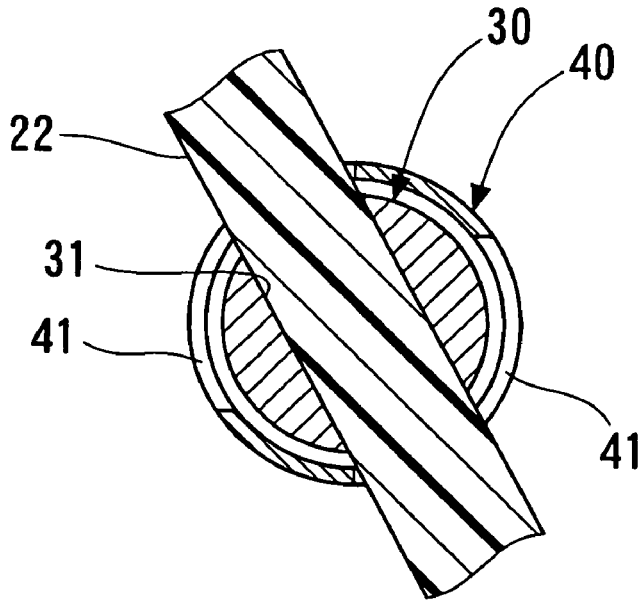
FIG. 5B is an enlarged sectional view showing the valve unit when the intake passage closes.

As referred to FIG. 1, the bearing member 40 penetrates the housings 21 of the valve units 20 similarly to the shaft 30. The bearing member 40 is formed of metal such as stainless steel to be in a substantially cylindrical shape. The shaft 30 is inserted into the bearing member 40. The bearing member 40 has the inner diameter that is slightly greater than the outer diameter of the shaft 30. The bearing member 40 rotatably supports the shaft 30. As shown in FIG. 3B, the bearing member 40 has openings 41 partially with respect to the axial direction of the bearing member 40. Each opening 41 corresponds to the hole 31 of the shaft 30, i.e., corresponds to the butterfly member 22 supported by the shaft. The opening 41 has length with respect to the axial direction of the bearing member 40. The length of the opening 41 is slightly greater than the width of the butterfly member 22. As referred to FIGS. 4A to 5B, the butterfly member 22 supported by the shaft 30 protrudes through the opening 41 with respect to the radial direction of the bearing member 40. As referred to FIGS. 5A, 5B, the opening 41 is defined in a predetermined range with respect to the circumferential direction of the bearing member 40. In this structure, the butterfly member 22 supported by the shaft 30 is not restricted by the bearing member 40 within the predetermined range defined by the opening 41. Therefore, the butterfly member 22 is rotatable together with the shaft 30 within the predetermined range defined by the opening 41.

The bearing member 40 is insert-molded in the housing 21, so that the bearing member 40 is integrated with the housing 21. The shaft 30 is insert-molded in the butterfly members 22, so that the shaft 30 is integrated with the butterfly member 22. The shaft 30 is inserted in the bearing member 40, such that the shaft 30 is rotatable in the bearing member 40. The shaft 30 rotates in the bearing member 40, so that the butterfly members 22 integrally supported by the shaft 30 rotate in the housings 21. The butterfly members 22 communicate and block the intake passages 23 in the housings 21 by rotating between a full open position shown in FIGS. 4A, 5A and a full close position shown in FIGS. 4B, 5B.

Figure 2:
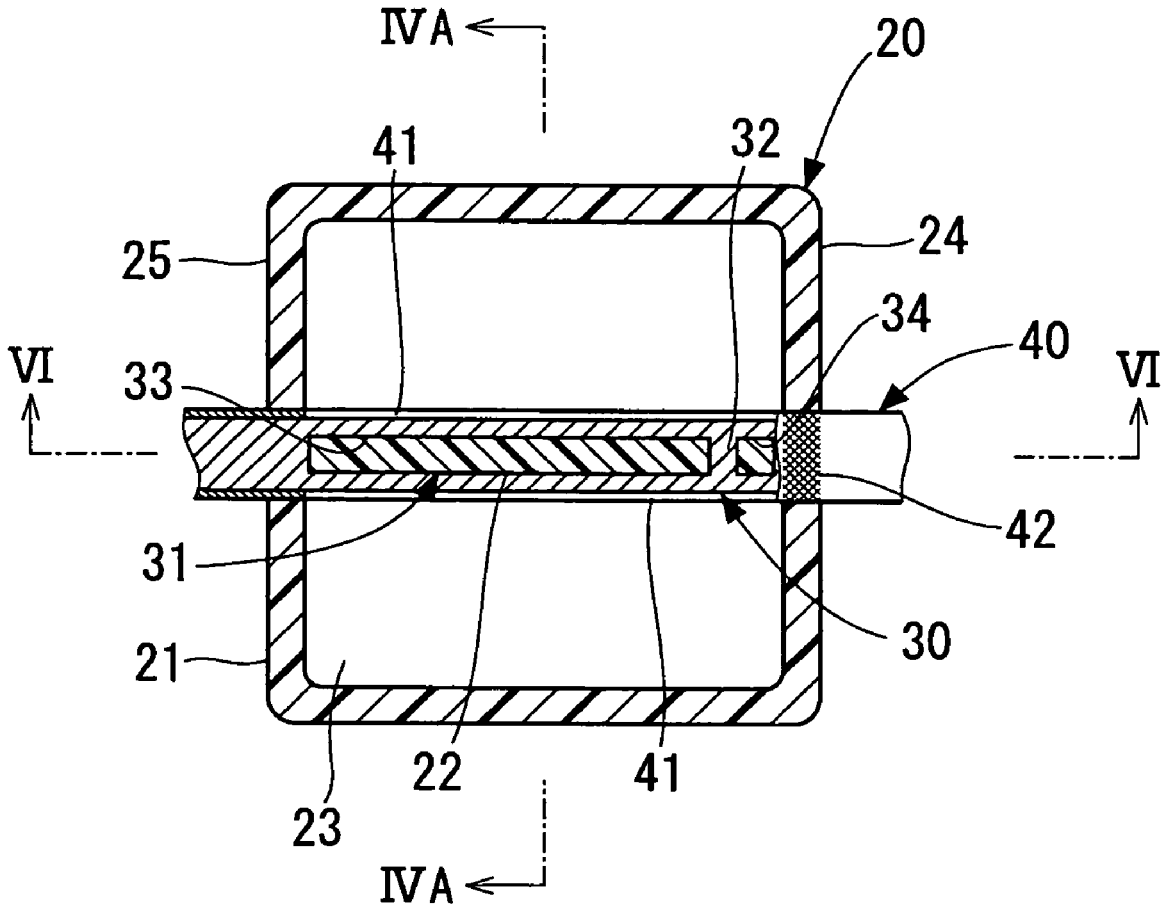
FIG. 2 is a sectional view showing a valve unit of the intake apparatus when being viewed perpendicularly to an intake passage.
Figure 6:
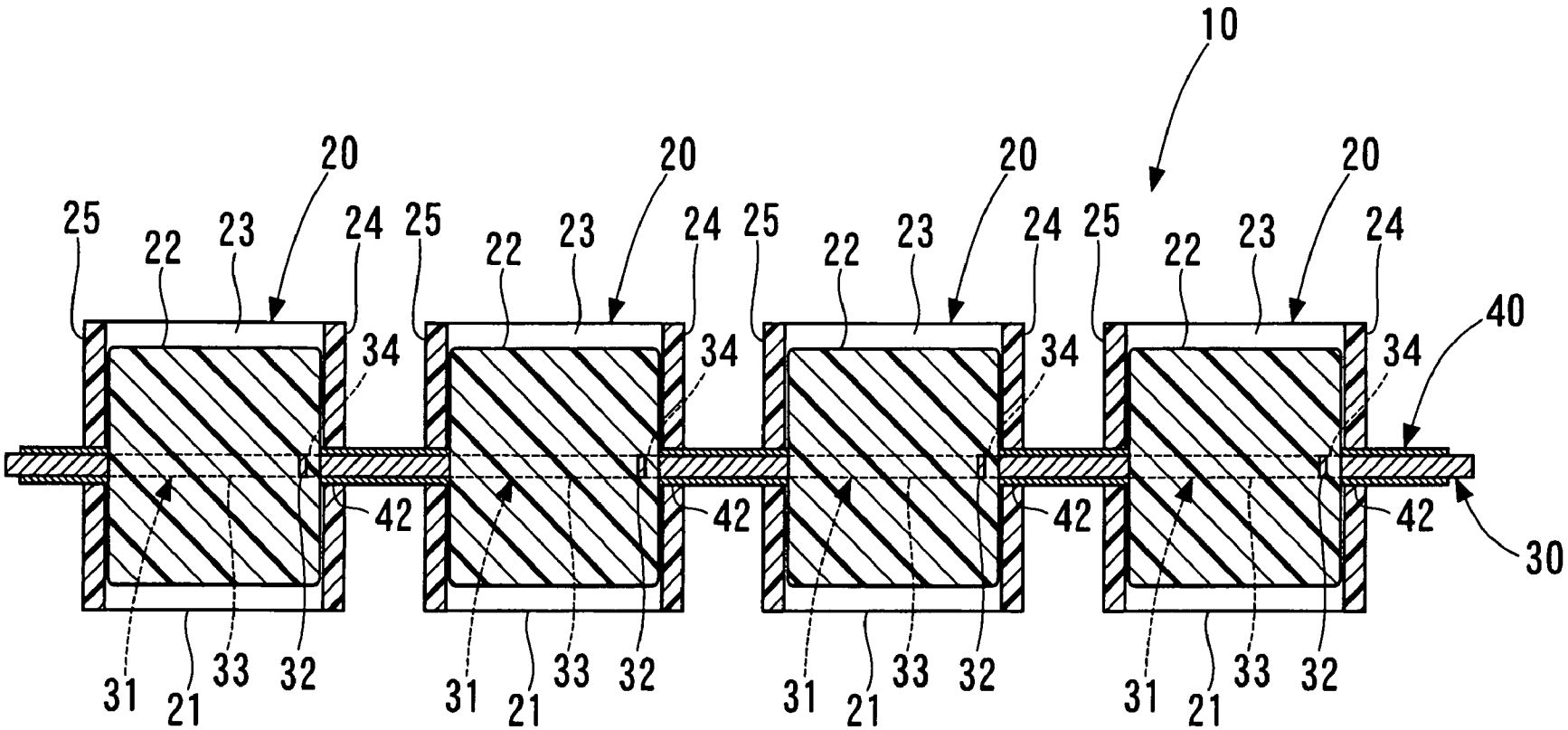
FIG. 6 is a sectional view taken along the line VI-VI in FIG. 2.

As shown in FIGS. 2, 3B, the bearing member 40 has knurled portions 42 respectively in the vicinity of the openings 41. Each knurled portion 42 has small protrusions and recessions formed on the outer periphery of the bearing member 40. The knurled portion 42 is located on one end side of the opening 41 with respect to the axial direction of the bearing member 40. Bonding strength between the bearing member 40 and the housing 21, which is formed of resin, can be enhanced by forming the knurled portions 42 in the bearing member 40. As referred to FIGS. 2, 6, the bearing member 40 penetrates two walls (first wall and second wall) 24, 25 of each housing 21. Each knurled portion 42 is formed on the side of one wall 24 of the two walls 24, 25. The bearing member 40 is insert-molded in the housing 21. In this structure, bonding strength between the bearing member 40 and the one wall 24 is greater than bonding strength between the bearing member 40 and the other wall 25.

The housing 21 is formed of resin, and the bearing member 40 is formed of metal. The thermal expansion coefficient of the housing 21 is different from the thermal expansion coefficient of the bearing member 40. The housing 21 is strongly bonded to the bearing member 40 via the knurled portion 42 surrounded by the one wall 24. As temperature changes, dimensional change between the housing 21 and the bearing member 40 arises with respect to the one wall 24 surrounding the knurled portion 42. In this structure, adjacent housings 21 are spaced from each other. Therefore, dimensional change between each housing 21 and the bearing member 40 is absorbed in each valve unit 20. Thus, dimensional change arising in one housing 21 may not exert effect to another valve unit 20, which is adjacent to the one housing 21, even in the structure, in which the valve units 20 are connected commonly via the bearing member 40.

The shaft 30 has the blockade portions 32 each located on the one end side of the opening 41 on the same side as the knurled portion 42 with respect to the axial direction of the shaft 30. The butterfly members 22 are formed of resin as including the shaft 30 therein. Each butterfly member 22 penetrates, i.e., extends through each hole 31 excluding each blockade portion 32 in the shaft 30. In this structure, the blockade portion 32 maintains the butterfly member 22 relatively to the shaft 30 with respect to the axial direction of the shaft 30. Thus, as temperature changes, dimensional change arises in the butterfly member 22 with respect to the blockade portion 32. That is, as temperature changes, dimensional change of the butterfly member 22 starts relative to the blockade portion 32 as a center of dimensional change. In this structure, the butterfly members 22 are connected commonly via the shaft 30. Dimensional change between each butterfly member 22 and the shaft 30 is absorbed in each valve unit 20, so that dimensional change arising in one butterfly member 22 may not exert effect to adjacent valve unit 20.

Furthermore, each knurled portion 42 of the bearing member 40 and each blockade portion 32 of the shaft 30 are located on the side of the one wall 24 of the housing 21. In this structure, dimensional change is caused with respect to the one wall 24 when expansion or shrinkage arises between the bearing member 40 and the housing 21, or when expansion or shrinkage arises between the butterfly member 22 and the shaft 30. That is, dimensional change is caused with respect to the one wall 24 as a center of expansion or shrinkage. A movable clearance is secured between each housing 21 and corresponding butterfly member 22 for maintaining smooth operation therebetween. In this structure, when temperature changes in the intake apparatus 10, dimensional change in this movable clearance can be reduced. Thus, the movable clearance between each housing 21 and corresponding butterfly member 22 can be minimized, so that leakage of air can be reduced when the butterfly member 22 is in the full close position in the intake passage 23.

Next, a method for manufacturing the intake apparatus 10 is described. The shaft 30 is inserted into the inner periphery of the bearing member 40 being in the substantially cylindrical shape. The bearing member 40 accommodating the shaft 30 is put in an unillustrated molding die. The molding die is charged with resin for molding the housings 21 and the butterfly members 22. The shaft 30 and the bearing member 40 are simultaneously insert-molded respectively in the butterfly members 22 and the housings 21. In this condition, resin for molding the butterfly members 22 is charged through the holes 31 of the shaft 30. The bearing member 40 is molded integrally with the housings 21, and the shaft 30 is molded integrally with the butterfly members 22 by insert-molding the bearing member 40 and the shaft 30 respectively in the housings 21 and the butterfly members 22. Adjacent valve units 20 are simultaneously molded individually from each other. As referred to FIGS. 2, 4A, 5A, and 6, the intake apparatus 10 is formed such that each butterfly member 22 is in the full open condition in each intake passage 23 of each valve unit 20. In this example, the valve units 20 are integrally formed simultaneously with the shaft 30 and the bearing member 40. In this manufacturing process of the intake apparatus 10 including the valve units 20, the housing 21 and the butterfly member 22 need not be formed and assembled for each valve unit 20. The shaft 30 need not be assembled individually to each valve unit 20. Thus, forming the valve units 20 and assembling the shaft 30 can be simultaneously performed, so that manufacturing process of the intake apparatus 10 can be significantly reduced.

That is, the method for manufacturing the intake apparatus 10 may include the following processes. For example, the shaft 30 is inserted into the bearing member 40. For example, the openings 41, which are axially spaced from each other in the bearing member 40, are aligned with respect to holes 31, which are axially spaced from each other in the shaft 30. For example, the resin is injected through the openings 41 and the holes 31 to insert-molding the bearing member 40 and the shaft 30 in butterfly members 22 and the housings 21, such that each butterfly member 22 extending through each hole 31 and each valve member being accommodated in each housing 21.

In this structure, the butterfly members 22 are respectively accommodated in the housings 21, and are supported using one shaft 30. The material of the housings 21 is different from the material of the shaft 30 and bearing member 40. The thermal expansion coefficient of the housings 21 is different from the thermal expansion coefficient of the shaft 30 and bearing member 40.

According to the above prior art of U.S. Pat. No. 6,979,130, the shaft is provided to each bearing unit, so that the bearing unit, the flap, and the shaft are movable relatively to each other, and thus, difference between the thermal expansion coefficients is absorbed. However, in this structure of U.S. Pat. No. 6,979,130, the bearing unit and the flap define a gap therebetween. Air may leak through the gap, and consequently, engine performance may be degraded.

On the contrary, in this example, the bearing member 40 has the knurled portions 42 each restricting the bearing member 40 from moving relative to the corresponding housing 21. The shaft 30 has the blockade portions 32 each restricting the shaft 30 from moving relative to the corresponding butterfly member 22. In this structure, as temperature changes, expansion or shrinkage of each housing 21 and each butterfly member 22, which are formed of resin, are caused with respect to each knurled portion 42 and each blockade portion 32. Expansion or shrinkage of the housing 21 and butterfly member 22 can be absorbed in each valve unit 20. Thus, even in this structure, in which the butterfly members 22 are connected commonly via the shaft 30, dimensional change arising in one butterfly member 22 is not apt to exert effect to adjacent valve unit 20.

In this example, the shaft 30 can be formed of a material same as the material of the bearing member 40. Even temperature changes, difference in axial dimensions between the shaft 30 and the bearing member 40 can be significantly reduced. Furthermore, each knurled portion 42 of the bearing member 40 and each blockade portion 32 of the shaft 30 are located on the side of the one wall 24 of the housing 21. The housing 21 and the butterfly member 22 shrink or expand with respect to the one wall 24. In this structure, the movable clearance, which is secured between each housing 21 and corresponding butterfly member 22 for maintaining smooth operation therebetween, can be reduced. Thus, the gap between each housing 21 and corresponding butterfly member 22 can be reduced when the butterfly member 22 is in the full close position in the intake passage 23, so that leakage of air can be reduced.

The number of the cylinders of the engine is not limited to four. The above structure of the intake apparatus 10 may be applied to any engines other than the four-cylinder engine.

In the above example, the butterfly member 22 is substantially symmetrical with respect to the shaft 30, and the butterfly member 22 is suspended on both sides thereof by the shaft 30, so that the butterfly member 22 communicates and blocks the intake passage 23 corresponding to rotation of the shaft 30. Alternatively, the butterfly member 22 may be asymmetrical with respect to the shaft 30, and the butterfly member 22 may be suspended on one side thereof by the shaft 30. That is, the butterfly member 22 may be eccentric with respect to the shaft 30, and may have a cantilever structure for communicating and blocking the intake passage 23.

In the above example, each butterfly member 22 extends through each hole 31 of the shaft 30. Alternatively, the shaft 30 may have a groove, and each butterfly member 22 may be fitted into the bottom of the groove.

The cross sectional shape of the intake passage 23 defined in the housing 21 is not limited to the rectangular shape. The intake passage 23 may have any cross sectional shapes such as circular shape and polygonal shape.

In the above example, the structure is used in the intake apparatus. However, the structure is not limited to be used in an intake apparatus. The structure can be applied to any other fluid apparatus having a rotary valve structure.

It should be appreciated that while the processes of the example have been described herein as including a specific sequence of steps, further alternative examples including various other sequences of these steps and/or additional steps not disclosed herein are intended to be within the steps of the present invention.

Various modifications and alternations may be diversely made to the above embodiments without departing from the spirit of the present invention.

What is claimed is:

1. An intake apparatus comprising:

a plurality of housings each defining an intake passage therein;

a plurality of valve members each being provided to each housing for communicating and blocking the intake passage;

a shaft that extends through the plurality of housings, the shaft being rotatable integrally with the plurality of valve members; and a bearing member that extends together with the shaft through the plurality of housings, wherein the bearing member is supported by the plurality of housings, the bearing member is in a substantially cylindrical shape, the shaft is rotatable in the bearing member, the bearing member includes a plurality of exposed portions each being exposed to the intake passage, each exposed portion has an opening that extends with respect to an axial direction of the bearing member, and the opening corresponds to a rotatable range, in which the valve member is rotatable with respect to a circumferential direction of the bearing member.

2. The intake apparatus according to claim 1, wherein the shaft has a plurality of holes, and each valve member extends through each hole with respect to a radial direction of the shaft.

3. The intake apparatus according to claim 2, wherein the shaft has a plurality of blockade portions each partially blocking each hole.

4. The intake apparatus according to claim 1, wherein each housing has a first wall and a second wall, the bearing member connects with the housing via the first wall and the second wall, the bearing member has a plurality of knurled portions, and each knurled portion is located on a side of the first wall.

5. The intake apparatus according to claim 4, wherein each blockade portion and each knurled portion are on a same side with respect to an axial direction of the shaft.

6. The intake apparatus according to claim 1, wherein the intake passage defines part of an air inlet passage of an internal combustion engine.

7. A method for manufacturing an intake apparatus, the method comprising:

inserting a shaft into a bearing member, the bearing member having a plurality of openings that are axially spaced from each other for predetermined distances, the shaft having a plurality of holes that are axially spaced from each other corresponding to the plurality of openings; and insert-molding the bearing member and the shaft in resin to simultaneously form a plurality of valve members and a plurality of housings, wherein each valve members extends through each hole, and each housing has an intake passage that accommodates each valve member.

8. An intake apparatus comprising:

a plurality of housings each defining an intake passage therein;

a plurality of valve members each being provided to each housing;

a bearing member that extends through the plurality of housings, the bearing member being fixed to the plurality of housings, a shaft that extends through the bearing member and the plurality of housings, wherein the bearing member has a plurality of openings, each valve member extends from the shaft substantially along a radial direction of the shaft, each valve member extends into the intake passage through each opening, the shaft is rotatable in the bearing member integrally with the plurality of valve members for communicating and blocking the intake passages of the plurality of housings, and each opening extends with respect to a circumferential direction of the bearing member to define a rotatable range in which each valve member is rotatable.

9. A method for manufacturing an intake apparatus, the method comprising:

inserting a shaft into a bearing member; and injecting resin through a plurality of openings of the bearing member and a plurality of holes of the shaft to insert-molding the bearing member and the shaft in a plurality of valve members, each extending through each hole, and a plurality of housings each accommodating each valve member.

10. A method for manufacturing an intake apparatus, the method comprising:

inserting a shaft into a bearing member;

aligning a plurality of openings, which are axially spaced from each other in the bearing member, with respect to a plurality of holes, which are axially spaced from each other in the shaft; and injecting resin through the plurality of openings and the plurality of holes to insert-molding the bearing member and the shaft in a plurality of valve members and a plurality of housings, such that each valve member extending through each hole and each valve member being accommodated in each housing.

* * * * *